United States Patent [19]

Albert

[11] Patent Number: 4,864,814

[45] Date of Patent: Sep. 12, 1989

[54] CONTINUOUS COMBUSTION HEAT ENGINE

[75] Inventor: Albert F. Albert, Bellevue, Wash.

[73] Assignee: Combustion Research & Technology, Inc., Seattle, Wash.

[21] Appl. No.: 153,517

[22] Filed: Jan. 29, 1988

Related U.S. Application Data

[63] Continuation of Ser. No. 802,845, Nov. 27, 1985, abandoned.

[51] Int. Cl.[4] ..... F01B 1/06; F01L 33/02; F02G 3/02

[52] U.S. Cl. ..... 60/39.63; 91/180; 91/491; 92/51; 123/78 B

[58] Field of Search ..... 60/39.6, 39.63; 91/491, 91/492, 493, 495, 180; 92/51; 123/44 B, 78 B

[56] References Cited

U.S. PATENT DOCUMENTS

| | | | |
|---|---|---|---|
| 1,037,400 | 9/1912 | Youngren | 123/44 B |
| 1,252,269 | 1/1918 | Johnson | 123/78 B |
| 2,217,796 | 10/1940 | Dell | 123/44 B X |
| 3,608,308 | 9/1971 | Cary et al. | 60/39.63 |

*Primary Examiner*—Michael Koczo
*Attorney, Agent, or Firm*—George M. Cole

[57] ABSTRACT

Continuous combustion heat engine including a compressor (12), combustor (14) and expander (16) which operates on a Brayton cycle with positive displacement pistons (90) in the compressor and variable expansion ratio pistons (190) in the expander. Compressor (12) delivers compressed air to the combustor (14) where it is mixed with fuel and combusted to produce expansion gases for the expander (16). Power input to the compressor and power output from the expander are achieved through the radially disposed pistons (90,190), connecting rods (94), cranks (98), crank shafts (100), planetary gears (104), sun gears (106) and sun gear connectors (114) which rotatably secure the sun gears (106) and manifolds (110,166) together. The pistons (190) for the expander have positive displacement sections (192) and free floating sections (200) for the variable volume ratio capability. A variable speed drive (17) may be incorporated between the compressor and expander to increase pressure in the compressor when the expander is operating at less than full load.

40 Claims, 7 Drawing Sheets

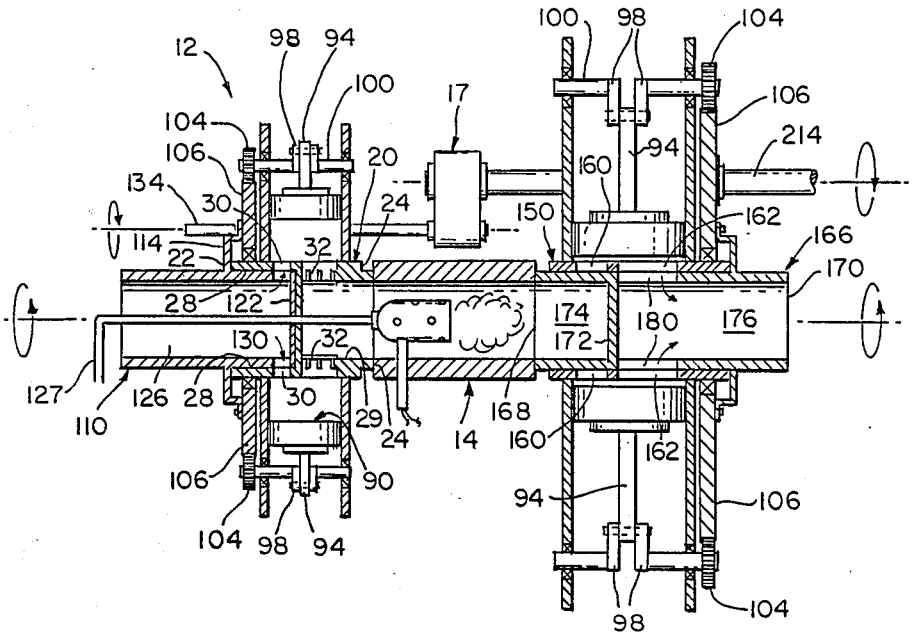
FIG. 1
FIG. 2
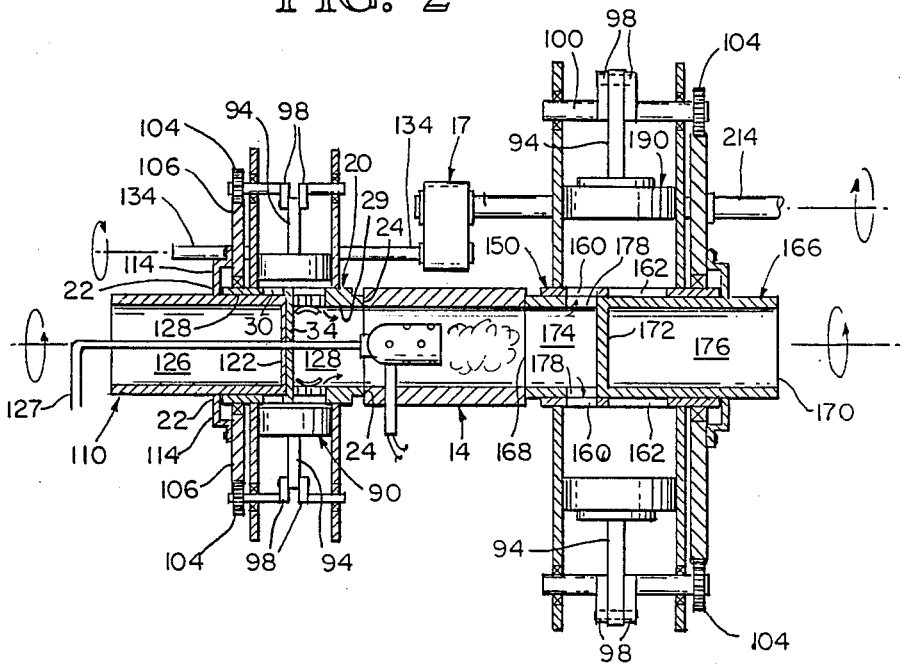

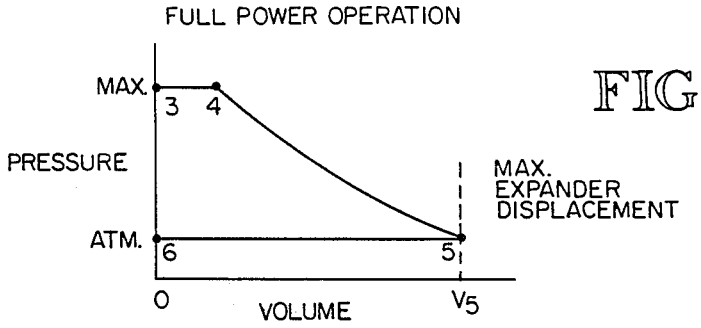
FIG. 12
FIG. 13A
AT POINT 3
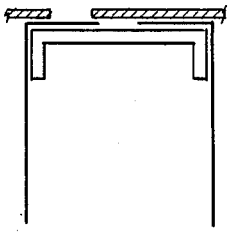
FIG. 13B
HALFWAY 3 TO 4
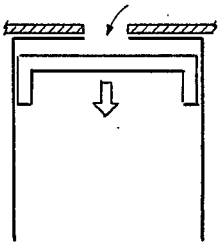
FIG. 13C
AT POINT 4
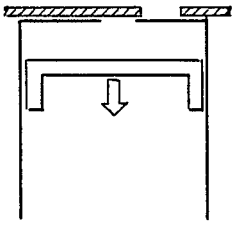
FIG. 13D
ENROUTE TO PT. 5
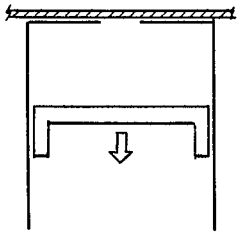
FIG. 13E
AT POINT 5
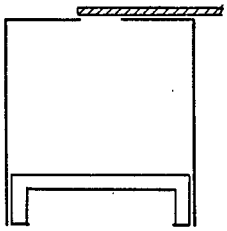
FIG. 13F
PROCESS 5-6
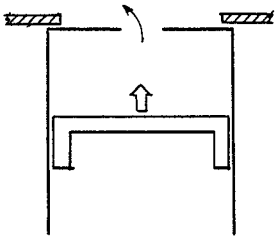
FIG. 13G
AT POINT 6
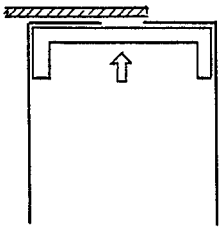

AT POINT A

AT POINT 5'

AT POINT B OR C

AT POINT D

CONTINUOUS COMBUSTION HEAT ENGINE

This application is a continuation of application Ser. No. 802,845 filed Nov. 27, 1985, now abandoned.

TECHNICAL FIELD

This invention relates to a continuous combustion heat engine employing a Brayton cycle and more particularly to a continuous combustion engine with positive displacement work components which also has a variable volume ratio expander and a variable pressure ratio compressor to accommodate varying load requirements of the engine.

BACKGROUND ART

As is well known by the public and particularly those in the petroleum and automotive industries, the forces limiting supplies and increasing prices of liquid hydrocarbon fuels have provided the impetus for the development of better and more efficient engines. The factors sought in general are low first cost, low maintenance costs, long service life, low vibration and noise, good fuel economy, low emissions, low bulk and weight, fast response, easy starting, and ability to utilize a wide range of hydrocarbon fractions.

Desirable properties for most efficient use of the fuels include combustion at the highest possible temperature, a short fuel burning time, completeness of combustion before expansion, low radiation, conductive and convective heat loss to the confining structure. Low exhaust gas temperature following the maximum extraction of mechanical work during the expansion process is a cycle design food for high efficiency. Mechanical considerations for most efficient use of the materials of construction include high strength/density ratio for the minimum material cost, the least possible use of exotic or rare alloying elements, high internal damping coefficient for parts subject to vibration, and long fatigue/-wear life for parts which move or which are subject to flexure and/or abrasion..

Conventional two-cycle or four-cycle reciprocating or rotary engines utilize intermittent or cyclic combustion processes to permit in turn a lower average temperature suitable to the materials such as aluminum or cast iron. The combustion temperatures exceed 3,000 degrees F. for a short time, but the average piston temperature is lower than 500 degrees F. as heat is conducted away by coolants, lubricants, and the incoming charge air.

Gas turbine engines employ constant pressure combustion and continuous burning within a combustion chamber supplied with excess air for cooling the chamber walls and protection of the turbine nozzle and blading. Extremely high speeds of rotating compressors and turbines pose a potential hazard and require protective shields in the plane of rotation. The main advantages are very light weight, complete combustion, and freedom from vibration. The disadvantages of turbines include slow starting, high fuel consumption particularly at part power operation, susceptibility to blade erosion and damage which results in degraded performance, and sensitivity to matching compressor flow to the turbine capacity without stalling or surging the flow in the compressor.

The engine industry has attempted to combine the multi-piston reciprocating engine with high speed turbines in combiantions ranging in form from turbinecharged engines that have been commonly accepted for over 40 years, to free-piston engines that have been used as the combustor for power turbine output drives. All of these attempts have sought to use the highly efficient but momentary and cyclic operation of the piston-cylinder combustion chamber.

In any open cycle heat engine the working fluid experiences three major processes, namely compression, heating and expansion. Each of the three major processes may be carried out in a separate component and thus one separates the various processes. By contrast, heat engines like the Otto and Diesel cycles are designed as a single physical component to carry out the required functions which occur at successive times. Thus such engines are intermittent combustion engines.

If the designer can develop each component to deal with its particular function and characteristic without being involved with the other two functions, then the efficiency of each process can be increased significantly. For example, the compressor component can be designed without considering high temperature, emission characteristics, etc. since its only function is to compress and deliver air to the combustion component. Ideally, the combustor's single purpose is to receive the compressed air from the compressor and to receive fuel which is separately introduced. The separation of components allows continuous combustion and therefore the combustion process has a truly multi-fuel capability limited only by the designer's ability to inject the fuel into the combustion chamber. Gaseous, solid or liquid fuels could be used in this steady, constant pressure combustion process.

This invention improves the efficiencies of a predecessor engine as shown in U.S. Pat. No. 4,336,686 by using crank shafts instead of a cam configuration. The instant invention departs radically from the engine in the referenced patent because of the positive connection through the cranks to convert reciprocal to rotary motion. Thus, the prior patent is not pertinent to the engine described and claimed herein. Applicant knows of no art which is pertinent to this invention.

DISCLOSURE OF THE INVENTION

The instant invention is a continuous combustion heat engine which utilizes a multi-piston compressor component for delivery of air to the combustion chamber and a positive displacement piston expander. The expander has a variable volume ratio while the compressor has a variable pressure ratio. Each piston is provided with its own crankshaft which is geared to an output shaft for the power output. A variable speed drive may be located between the expander and the driven compressor.

Accordingly, it is among the features of the invention to provide an engine which functions in a continuous combustion process and thus has no spark or injection timing requirements. The pressure ratio of the engine is chosen by cycle requirements and is not dependent upon the characteristics of the specific fuels utilized such as must be done for the Otto or Diesel cycle engines. The design of the engine enables the pressure ratio to be optimized regardless of engine operation. Varying power demand on the engine will require the pressure to change and thus variability is accommodated by the instant design. The engine is a slow speed machine like the Otto and the Diesel. Unlike the gas turbine engine, the instant design is practical in any size range. Because it has the continuous combustion damaging spike heat and pressure loading on mechanical components is eliminated, an undesirable characteristic of both the Otto and the Diesel engines. Like the Rankine cycle this engine has torque at rest or idling. The cycle is operated at relatively low combustion temperatures mitigating against nitrogen oxide formation and permitting essentially complete combustion. Accordingly, pollution by the cycle is significantly lower than with heretofore known engines. The unique mechanical design of the engine permits relatively simple and inexpensive components, such as single throw crankshafts for example. Additionally, the engine uses ported aspiration as opposed to complex valving systems and mechanical systems associated therewith. There are no cam shafts, push rods and other associated timing mechanisms which are integral parts of the Otto and Diesel engines. The design allows the incorporation of variable volume ratio in the expander component. With the separated major three functions the designer is able to design the expander with a unique variable volume capability which is especially valuable in automotive applications where load demand on engines is continuously and constantly varying.

Since gas speeds through the engine are slow it does not suffer the component efficiency losses associated with the aero-dynamic work components of the gas turbine. Because the engine has the capability of large speed range, variable pressure ratio compressor and variable volume ratio expander, the use of this engine in an automotive duty cycle becomes very practical. The torque characteristics will require less complex transmissions than the characteristics of current transmissions. The variable expansion ratio piston allows the expander to produce power efficiently as inlet pressure at the beginning of the power stroke in the expansion process varies. The pressure is determined by the combustion chamber temperature which in turn is determined by power demand, i.e., the fuel input rate.

BRIEF DESCRIPTION OF THE DRAWINGS

FIG. 1 is a diagrammatic cross-section of the engine of this invention showing the compressor taking in air and the expander exhausting gases;

FIG. 2 is a diagrammatic cross-section of the invention with the compressor injecting compressed air into the combustor and gases entering the expander;

FIG. 12 is a graph of the full power cycle of the invention;

FIGS. 13A through 13G illustrate specific state points of the cycle of this invention at full power;

BEST MODE FOR CARRYING OUT THE INVENTION

Compressor

FIGS. 1 through 11 are directed to the details of the structure of the compressor, combustor and expander components.

Figure 4:
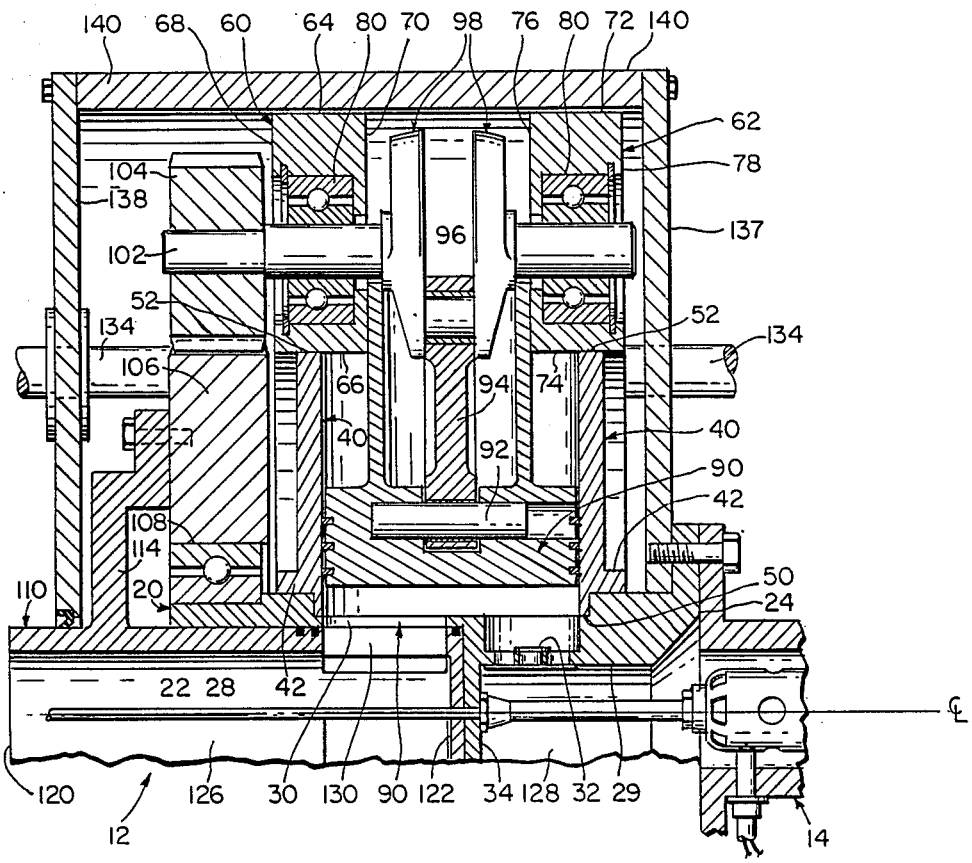
FIG. 4 is a partial cross-section view of the compressor showing details of construction thereof.
Figure 6:
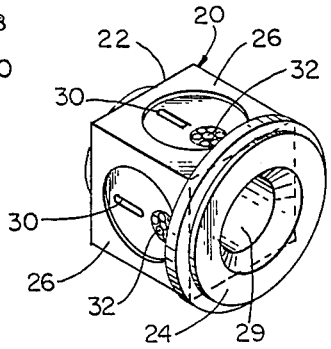
FIG. 6 is a view in perspective of the cylinder block of the compressor.

The engine of this invention has a compressor component generally designated by the number 12, a combustor 14 and an expander 16. Except for specific differences to be noted, the compressor 12 and expander 16 are generally similar. Thus, the exploded view 3 applies to both compressor and expander components except for differences between designs of the piston head shown in one part of the figure, the block and the manifold. Cylinder block 20 of the compressor as shown in FIG. 6 is generally in the shape of a cube or rectangular block having inlet end 22 and outlet end 24 together with four cylinder mounting sides or faces 26. A round manifold cavity 28 extends from inlet end 22 to block partition wall 34 near the center of the block to accommodate the rotating manifold which will be described hereinafter. Interconnecting each of the cylinder mounting faces 26 with the manifold cavity 28 are narrow inlet ports 30. Outlet ports 32 as seen in FIGS. 4 and 6 particularly will be provided with a one-way pressure differential valve for the compressed air which is discharged from the compressor through the outlet or discharge port 32. The block partition 34 is between inlets 30 and outlets 32 which open into outlet cavity 29.

Figure 3:
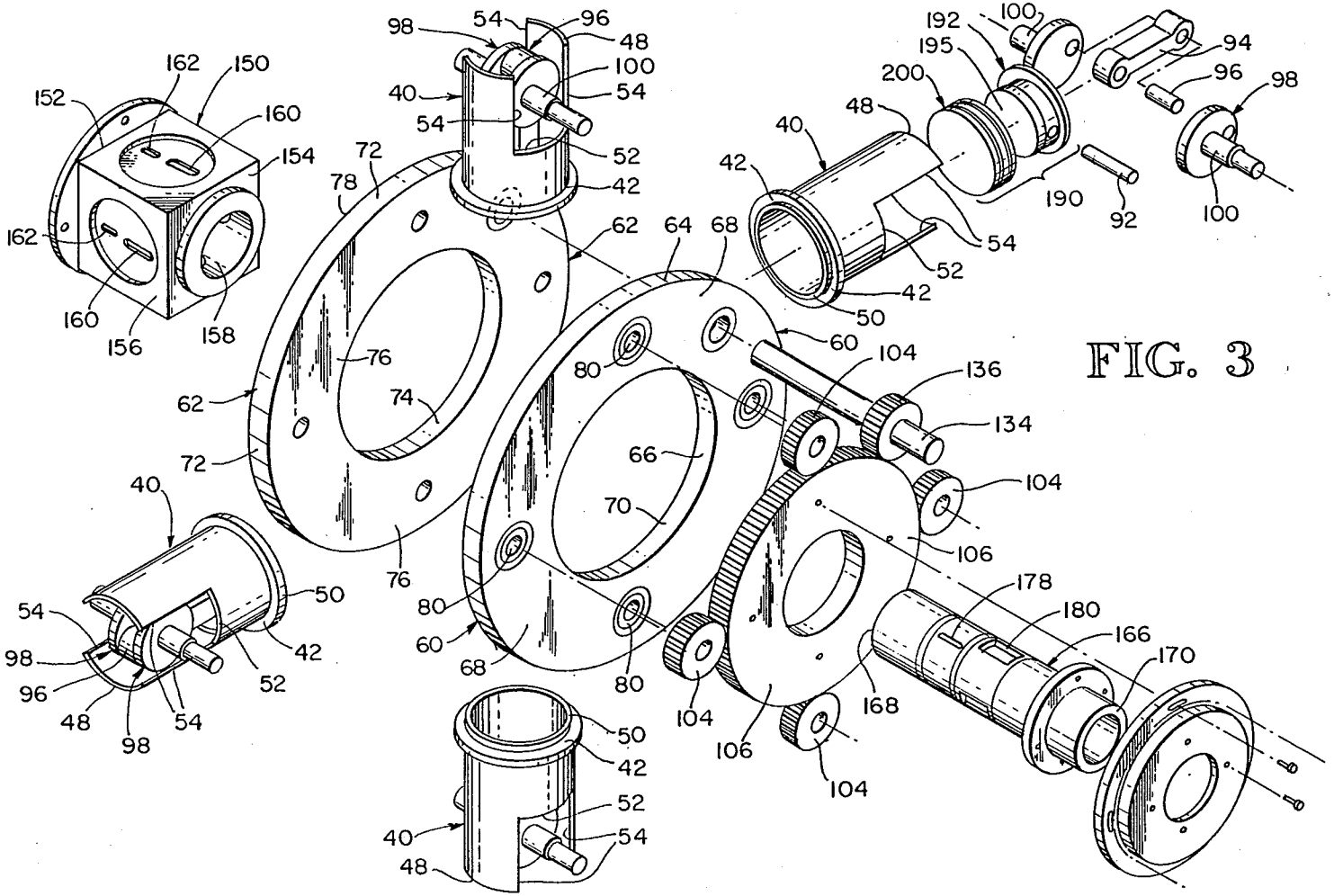
FIG. 3 is an exploded view of the basic elements of both the expander and the compressor.
Figure 5:
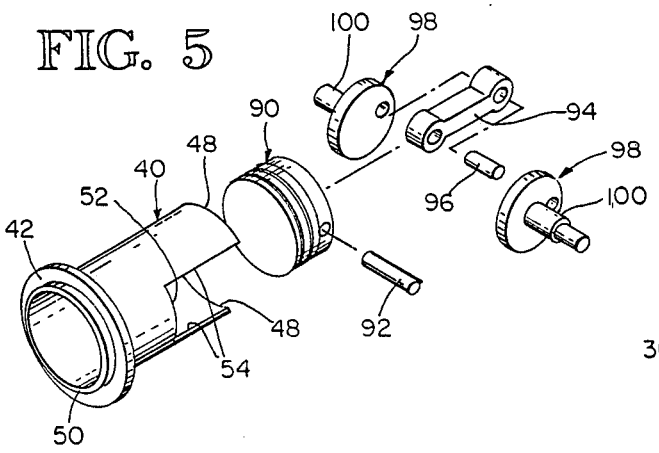
FIG. 5 is a partial view in perspective of the conventional piston structure of the compressor.

As mentioned above, with the exception of block 20 shown in FIG. 6, the manifold 20 and the exploded view of a one piece piston in FIG. 5 which are appropriate to the compressor 12, the remainder of the structure in FIG. 3 is applicable to both compressor and expander. Portions of FIG. 3 will carry dual numbering for compressor and expander for identification of parts where the parts are structurally different.

Block 20 of FIG. 6 will be provided with detachable cylinders 40 which are cylindrical members having bolt attachment flange 42 with a series of bolt holes which attach to bolt holes in the block by bolts.

The cylinders have an outer end 48 and the attachment end 50, facilitated by the annular attachment ring or flange 42. Each cylinder 40 is provided with two cutout portions defined by the lower edge 52 and the longitudinal edges 54 to form a cut-away area on opposing sides of the cylinder. The purpose of the cut-away portions at the upper half end of the cylinders will be set forth below.

Frame ring 60 has outside edge 64 and inside edge 66. Ring 60 also includes outside face or surface 68 and inside surface or face 70. It can be seen in FIG. 4 that the inside surface 66 of ring 60 abuts bottom edge 52 of the cut-away portions of each of the cylinders and that the inner surface 70 will generally abut the outwardly extending surfaces or edges 54 as best seen in FIG. 4. In like manner, ring 62 has outer edge 72, inner edge 74, inside face 76 and outside face 78. Crankshaft bearings 80 are located in both frame rings at locations as is best seen in FIG. 3.

Compressor 12 as seen in FIGS. 4 and 5 employs conventional pistons 90 connected by wrist pins 92 through connector rods 94 to crank pin 96 and crank 98 mounted on shafts 100 in bearings 80. A pinion shaft 102 extends coaxially from crankshafts 100 to one side of ring 60 and has keyed thereon a pinion gear 104. Pinion gear 104 in turn is driven by sun gear 106 mounted on bearings 108, reference being made to FIG. 4 particularly. It will be seen that in the embodiment shown four pistons with associated pinions 104 are provided.

A cylindrical manifold assembly generally designated by the number 110 carries an annular flange or gear connector 114. Gear connector 114 is attached, as can be seen by reference to FIG. 4, for rotation with sun gear 106 and rotation of manifold assembly 110.

Compressor manifold assembly 110 is an elongated cylindrical member having inlet end 120 and end wall 122 next to partition 34. Separator wall partition 134 divides or separates the manifold assembly having air inlet region 126 and compressed air discharge region 128. FIGS. 1 and 2 show that openings 130 in the manifold assembly 110 coincide with ports 30 and with the outward movement of piston 90 so that air is drawn in through opening 130 through port 30 in the block and into the compression chamber. In like manner, after the piston 90 has compressed the air in the chamber, the oneway valve in port 32 of the block opens and compressed air is released into compartment 128.

Driving power for sun gear 106 is provided by power shaft 134 through gear 136 which may be driven either by an expander associated with the compressor or other power source for delivering energy to the compressor via shaft 134.

Housing members 137, 138 and 140 are provided to encase the compressor. Fuel line 127 extends through air inlet chamber 126, manifold end wall 122, block partition wall 34, and a discharge chamber 128 to combustor 14.

Expander

The expander block shown in FIGS. 3 and 7 again is a cube or rectangular shaped member generally designated by 150 and having inner end 152 and outer end 154. It is also provided with cylinder mounting sides 156 of which in this embodiment there are four said cylinder mounting sides 156. The block has a manifold cavity 158 with each cylinder mounting face provided with a gas inlet port 160 and a gas outlet port 162. While the block 150 is shown as a cube, its outer shape may vary depending on design considerations such as the number of cylinders to be included.

Figure 7:
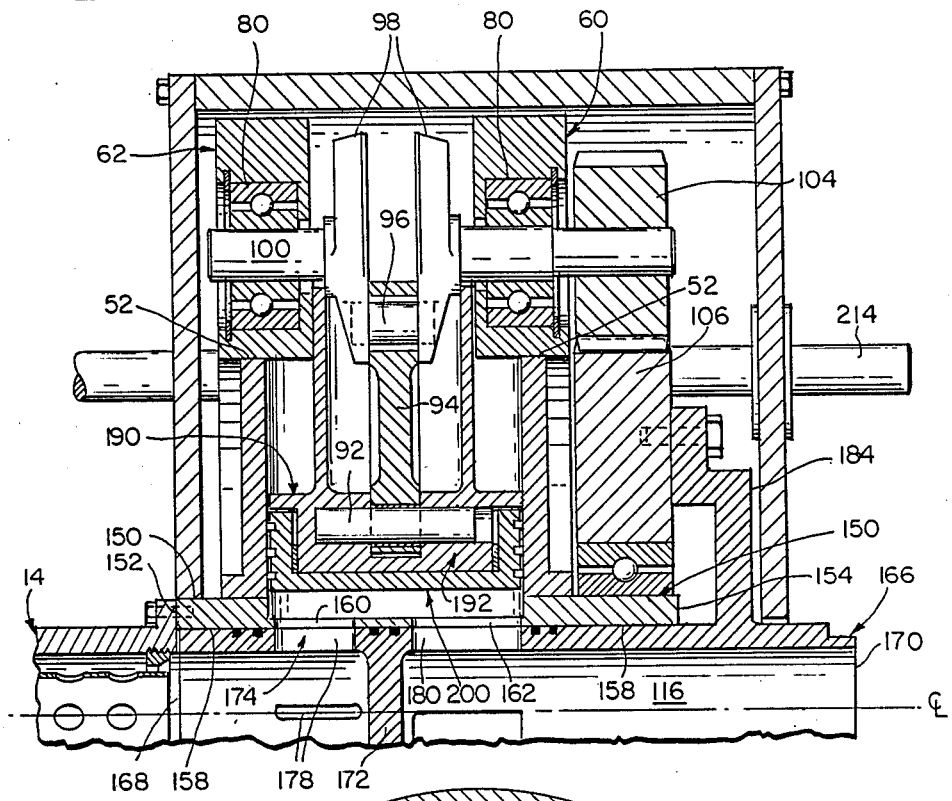
FIG. 7 is a partial cross-section view of the expander showing the two element construction of the variable expansion ratio piston.
Figure 8:
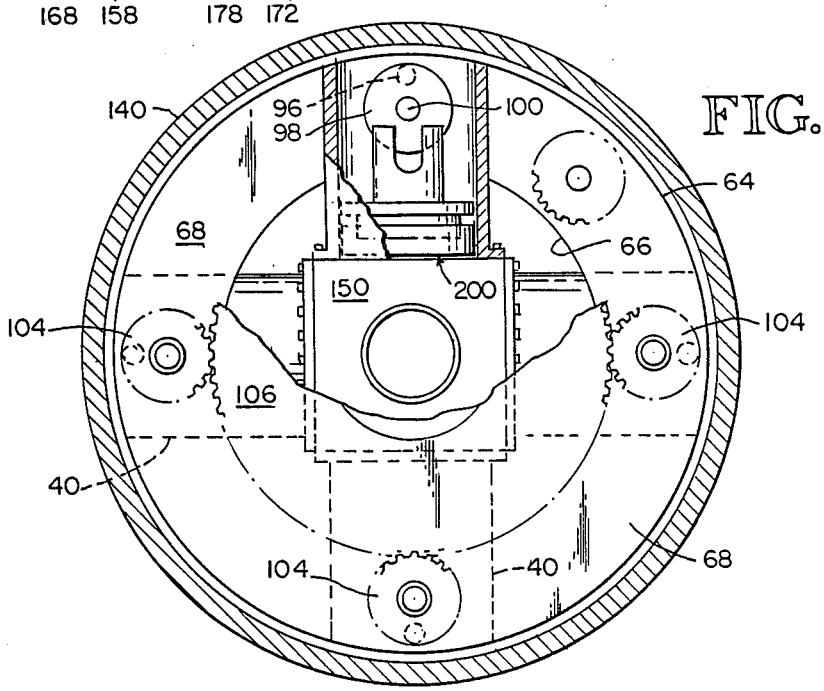
FIG. 8 is a partial elevation cross-section view showing additional details of construction of the expander.
Figure 9:
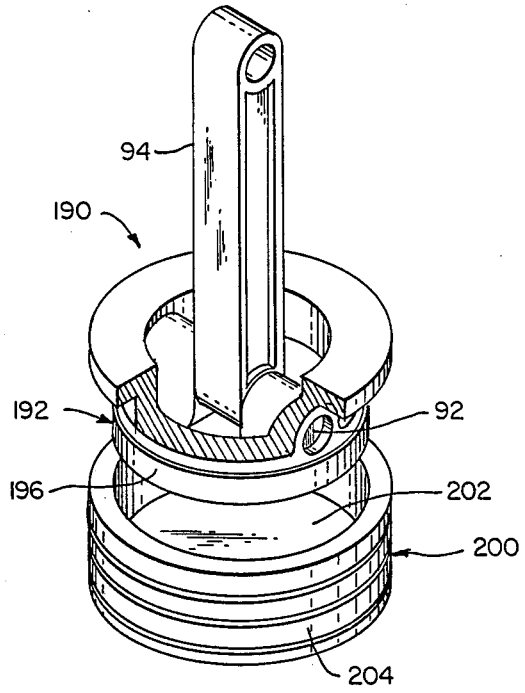
FIG. 9 is a view in perspective of the element head of the expander piston.
Figure 10:
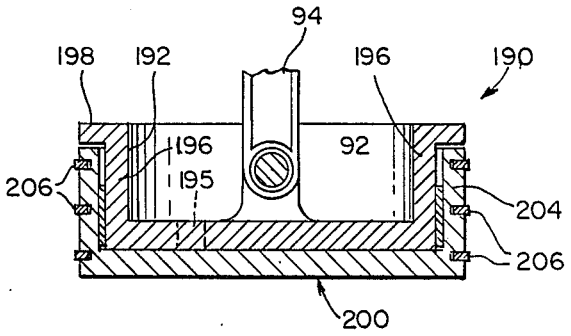
FIG. 10 is a partial cross-section view showing additional details of the variable expansion ratio piston.
Figure 11:
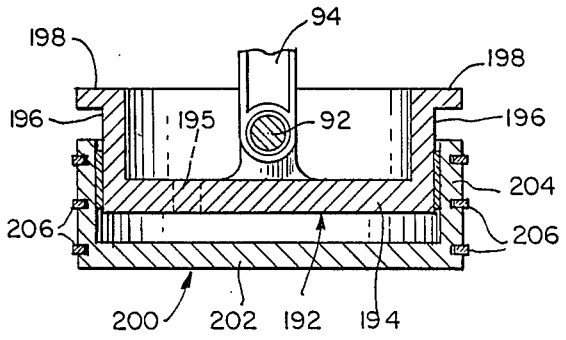
FIG. 11 is a partial cross-section view showing the piston of FIG. 7 with the bifurcated piston head sections separated.

A rotatable cylindrical manifold assembly 166, see FIGS. 1, 2, 3 and 7, has an inner end 168 and an exhaust end 170. A partition 172, as best seen in FIGS. 1, 2 and 7, is provided to separate the manifold assembly 166 into a gas inlet compartment 174 and a gas outlet compartment 176. Manifold 166 has gas inlet openings 178 and gas outlet openings 180. FIG. 7 shows that the manifold assembly is provided with an annular radially disposed mounting boss 184 which is operatively connected for rotation as a connector member to sun gear 106.

While the compressor 12 utilizes a one piece piston, the expander itself is provided with a variable expansion ratio piston generally designated by the number 190 the details of which are best seen in FIGS. 7 and 9 through 11. Piston 190 has a conventional or host portion generally designated by the number 192 which includes piston head 194, piston skirt 190 and annular radially disposed offset wall portion 198. A wrist pin 92 secures connecting rod 94 to crank 98. Mounted for limited free longitudinal movement independent of fixed piston head portion 192 is piston cap portion 200 with head 202 and skirt 204 with piston rings 206. As will be explained in more detail under discussion of the operation, the piston cap portion 200 of the expander pistons prevents the pressure in the cylinders from dropping below atmospheric pressure after the expansion cycle is complete. The skirt portion 196 of the host piston section 192 does not engage the cylinder wall. The skirt portion 204 of piston cap portion 200, with piston rings 206 does engage the cylinder wall providing effective sealing during the expansion process. A vent 195 is provided in the host section 192 to allow the free passage of air between the host and piston cap sections so that the finite movement of the host piston is not impeded by the variable movement of the piston cap portion 200 which is a function of the variable expansion ratio.

Combustor

As shown in FIGS. 1 and 2, a combustor is located between the compressor and the expander to receive compressed air from compressor 12. The combustion chamber is provided with an igniter 210 and fuel is admitted through nozzle or other appropriate means 212. The gases generated by the combustor are then directed to compartment 174 of the expander manifold 166 and into the expansion chamber to provide the power for driving the pistons 190, cranks 98, pinions 104 and sun gear 106 which in turn drives output shaft 214.

Output shaft 214 may be, and preferably will be, connected by a variable speed drive 17 to compressor 12. It will be appreciated, however, that compressor 12 does not require the expander described and claimed in this invention but can function independently when driven by any appropriate power source. In like manner, the expander is a functional component apart from the compressor as described and claimed. The constant pressure combustion process enables the combustor 14 to use a wide range of fuels with the compressed air.

Operation

Figure 14:
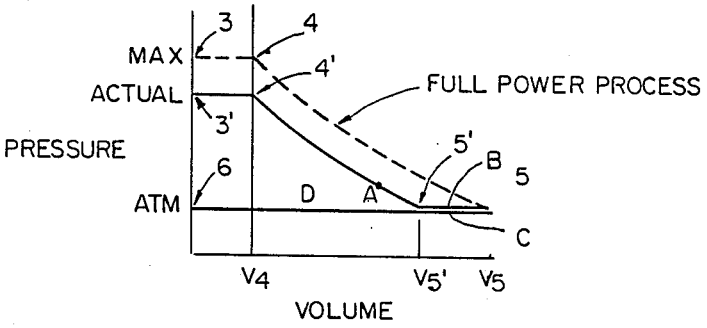
FIG. 14 is a graph of the cycle of this invention at part or low pressure operation.

FIGS. 13-15 together with the diagrammatic presentations of FIGS. 1 and 2 illustrate the operation of the engine of this invention.

FIGS. 12 and 13A-13G are presented to illustrate a full power cycle of operation in the expander. Line 3 to 4 represents the admission portion of the cycle which is further illustrated by FIGS. 13A through 13C. At point 4, admission of the high pressure expander gases is complete. Expansion of the gases takes place as represented by line 4 to 5 and FIGS. 13D and 13E. The high pressure expander gases drive the piston out to maximum volume of the expansion chamber, again represented by point 5. Line 5 to 6 represents atmospheric pressure and further illustrates the discharge or exhaust portion of the cycle.

Part Power or Low Pressure Operation

Figure 15A:
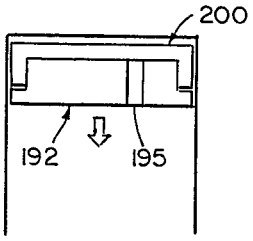
FIGS. 15A through 15D illustrate diagrammatically the operation of the variable expansion ratio piston of this invention during part load operation.
Figure 15B:
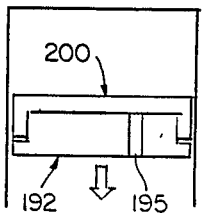
Figure 15C:
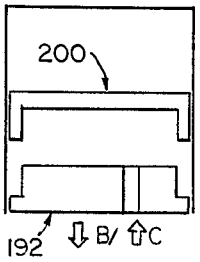
Figure 15D:
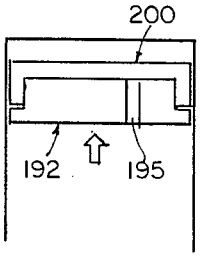

At less than full power in the cycle the admission portion of the cycle shows pressure at 3′ which is less than maximum pressure for full power operation. Reference here is to FIGS. 14 and 15A-15D. Line 3′ to 4′ represents the admission portion of the cycle and line 4' to 5' represents the expansion, the work generating portion of the cycle as the piston is forced outwardly from point 3' to 5'. To prevent the pressure within the expansion chamber from falling below atmospheric value, the piston may be inhibited or prevented from moving to maximum volume displacement represented by point 5. Thus as is shown in FIGS. 15A through 15D, when the pressure at the end of the expansion stroke has reached point 5 or atmospheric pressure the free floating piston portion 192 stops moving short of maximum displacement as is illustrated in FIGS. 15B and 15E. The fixed portion 192 of the variable expansion ratio piston continues to move out to maximum displacement while the free floating piston portion 200 is displaced to that point at which pressure in the expansion chamber is at atmospheric. The return stroke of the fixed portion 192 then returns, and re-engages free piston portion 200 as shown in FIG. 15D and the cycle is repeated.

It will be appreciated that pressure of the expander gases is controlled by temperature which in turn is a function of the fuel input to the combustor.

With reference to FIGS. 1 and 2, and as those skilled in the art will appreciate, displacement Brayton cycle engines have one unique characteristic which profoundly influences part load operation. That feature is that the volume of gas trapped in the expander prior to expansion is fixed. The fact that this volume is constant forces the pressure to vary as fuel input or equivalently, temperature is varied. Specifically, as temperature is reduced, pressure falls to maintain a balanced mass flow rate between compressor and expander. This reduced pressure degrades the thermodynamic cycle performance because at full power the pressure ratio is designed to be the best one for efficiency or power. Thus, it is desirable to devise a means to maintain high pressure as temperature is reduced. The variable speed drive between the compressor and the expander may be designed so that as temperature is reduced, the rotation ratio of the compressor is increased thereby increasing the mass flow into the expander which, as a result, maintains high pressure. Again, the high pressure is desirable for efficient functioning of the engine.

I claim:

1. A continuous combustion heat engine, comprising:

(a) a compressor having a first stationary block which includes a predetermined number of radially aligned and equispaced cylinders and pistons therein such that a first central manifold cavity is defined and wherein each cylinder has a first wall separating the cylinder from said manifold cavity and wherein each said first wall for each said cylinder is provided with an air inlet port and a compressed air outlet port, said air inlet ports and outlet ports being axially spaced apart, said first central manifold cavity including a first partition wall axially located between said air inlet and outlet ports to define and air inlet compartment on one side and a compressed air outlet compartment on the other side, each said cylinder further including a separate and simple eccentric crank mounted for rotatable movement radially outwardly of said first wall such that a connecting rod interconnects the piston in said cylinder with said simple eccentric crank to cause reciprocal movement of said piston within said cylinder, said compressor component also including separate pinion gear means connected to each eccentric crank and a first sun gear drive means to which each said pinion gear is operably connected for operably providing power to said compressor through said pinion gear means, rotatable generally cylindrical first manifold assembly means located in said air inlet compartment and including an air inlet opening for coacting with said air inlet port in said first wall whereby air admitted to said cylinders through said inlet compartment is compressed by said pistons and then directed through said compressed air outlet port to said outlet compartment, said compressed air outlet port including one-way valve means so that compressed air pressure in said cylinder must exceed the pressure in said outlet compartment in order for compressed air to flow into said outlet compartment, (b) a generally non-rotatable combustor component for receiving compressed air from said compressed air component and for receiving fuel to be mixed with said air for combustion to generate high temperature and pressure gases for an expander, (c) an expander component having a second stationary block means which includes a predetermined number of radially disposed and equispaced cylinders and piston means therein such that a second central manifold cavity is defined and wherein each cylinder has a second wall separating each cylinder from said second manifold cavity and wherein each said second wall for each said cylinder is provided with a gas inlet port and a gas exhaust port which are generally axially spaced apart, each said cylinder further including a separate and simple eccentric crank mounted for rotatable movement radially outwardly of said second wall such that a connecting rod interconnects the piston in said cylinder with said eccentric crank to cause driving rotation of said crank, said expander component also including separate pinion gear means connected to each simple eccentric crank and a second sun gear to which each said pinion gear is operably connected, said second sun gear having power take-off drive means connected thereto, and rotatable generally cylindrical second manifold assembly means located in said block and including a gas inlet compartment for receiving gases from said combustor and a gas outlet compartment axially separated from said gas inlet compartment by a second partition wall, said second manifold also having a gas inlet opening for coacting with said gas inlet port and a gas outlet opening for coacting with said gas outlet port whereby gas admitted to said cylinders causes outward driving power movement of said pistons and whereby exhaust gases are exited through said gas outlet compartment.

2. The heat engine according to claim 1 and in which said first manifold assembly means is connected for rotation with said first sun gear.

3. The heat engine according to claim 1 and in which said first sun gear and pinion gears connected thereto are driven by said power take-off means connected to said second sun gear means on said expander component.

4. The heat engine according to claim 1 and in which each said simple eccentric crank means for said compressor component is provided with first crank mounting shaft means rotatably received in first bearing means and wherein said first crank mounting shaft means are secured for positive rotation with pinion gear means operably connected to said first sun gear.

5. The heat engine according to claim 4 and in which said first sun gear and pinion gears connected thereto are driven by said power take-off means connected to said second sun gear means on said expander component 6. The heat engine according to claim 5 and in which each said simple eccentric crank means for said compressor component is provided with first crank mounting shaft means rotatably received in first bearing means and wherein said first crank mounting shaft means are secured for positive rotation with pinion gear means operably connected to said first sun gear.

7. The heat engine according to claim 1 and in which said second manifold assembly includes a second partition wall means for separating said gas inlet and gas outlet compartments.

8. The heat engine according to claim 1 and in which said second manifold assembly means is connected for rotation with said second sun gear.

9. The heat engine according to claim 1 and in which said second sun gear and pinion gears connected thereto are driven by said piston means in said expander component.

10. The heat engine according to claim 1 and in which each said simple eccentric crank means for said expander component is provided with second crank mounting shaft means rotatably received in second bearing means and wherein said second crank mounting shaft means are secured for positive rotation with pinion gear means operably connected to said second sun gear.

11. The heat engine according to claim 7 and in which said second manifold assembly means is connected for rotation with said second sun gear.

12. The heat engine according to claim 11 and in which said second sun gear and pinion gears connected thereto are driven by said piston means in said expander component.

13. The heat engine according to claim 12 and in which each said eccentric crank means for said expander component is provided with second crank mounting shaft means rotatably received in second bearing means and wherein said second crank mounting shaft means are secured for positive rotation with pinion gear means operably connected to said second sun gear.

14. The heat engine according to claim 1 and in which said first manifold assembly means is connected for rotation with said first sun gear and in which said second manifold assembly means is connected for rotation with said second sun gear.

15. The heat engine according to claim 1 and in which said first sun gear and pinion gears connected thereto are driven by said power take-off means connected to said second sun gear means on said expander component and in which said second sun gear and pinion gears connected thereto are driven by said piston means in said expander component.

16. The heat engine according to claim 1 and in which each said eccentric crank means for said compressor component is provided with first crank mounting shaft means rotatably received in first bearing means and wherein said first crank mounting shaft means are secured for positive rotation with pinion gear means operably connected to said first sun gear and in which each said eccentric crank means for said expander component is provided with second crank mounting shaft means rotatably received in second bearing means and wherein said second crank mounting shaft means are secured for positive rotation with pinion gear means operably connected to said second sun gear.

17. The heat engine according to claim 15 and in which said first manifold assembly means is connected for rotation with said first sun gear and in which said second manifold assembly means is connected with said second sun gear.

18. The heat engine according to claim 17 and in which said first sun gear and pinion gears connected thereto are driven by said power taken off means connected to said second sun gear means on said expander component and in which said second sun gear and pinion gears connected thereto are driven by said piston means in said expander component.

19. The heat engine according to claim 18 and in which each said simple eccentric crank means for said compressor component is provided with first crank mounting shaft means rotatably received in first bearing means and wherein said first crank mounting shaft means are secured for positive rotation with pinion gear means operably connected to said first sun gear, and in which each said simple eccentric crank means for said expander component is provided with second crank mounting shaft means rotatably received in second bearing means and wherein said second crank mounting shaft means are secured for positive rotation with pinion gear means operably connected to said second sun gear.

20. The continuous combustion heat engine of claim 1 and wherein a variable speed drive is disposed between said expander and compressor components to be driven by said expander component and to drive said compressor component such that the mass flow of air to said expander component is generally maintained during partial load and lower pressure operation of said expander component.

21. The continuous combustion heat engine according to claim 1 and wherein in the second stationary block means in said expander component each said piston is designed so as to included a first piston section to which said eccentric crank is connected and a free floating second piston section comprising the head portion of said pistons such that said second piston section is able freely to disengage said first piston section upon the occurrence of a predetermined pressure within the cylinder.

22. A positive displacement compressor device, comprising:

(a) a stationary block which includes a predetermined number of radially disposed equispaced cylinders and pistons therein such that a first central manifold cavity is defined and wherein each cylinder has a wall separating the cylinder from said manifold cavity and wherein each said wall for each cylinder is provided with an air inlet port and a compressed air outlet port, said air inlet ports and outlet ports being axially spaced apart, said central manifold cavity including a stationary partition wall axially located between said air inlet and outlet ports to define an air inlet compartment on one side and a compressed air outlet compartment on the other side, (b) each said cylinder further including a separate simple eccentric crank mounted for rotatable movement radially outwardly of said wall such that a connecting rod interconnects the piston in said cylinder with said simple eccentric crank to cause reciprocal movement of said piston within said cylinder, (c) said compressor component also including separate pinion gear means connected to each eccentric crank and a sun gear drive means to which each said pinion gear is operably connected for operably providing power to said compressor through said pinion gear means, and (d) rotatable generally cylindrical manifold assembly means located in said air inlet compartment and including an air inlet opening for coacting with said air inlet port in said wall, whereby air admitted to said cylinders through said inlet compartment and through said manifold assembly means is compressed by said pistons and then directed through said compressed air outlet port to said outlet compartment in said stationary central manifold cavity for admission to a stationary combustor.

23. the compressor device according to claim 22 and wherein said cylinder means are detachably secured to said block means.

24. The compressor device according to claim 22 and wherein frame ring means are provided on opposed sides of said cylinders, said frame ring mean being provided with separate bearing means for each of said simple eccentric cranks.

25. The compressor device according to claim 22 and wherein said sun gear is generally coaxial with said manifold assembly means.

26. The compressor device according to claim 22 and wherein each said air outlet port is provided with one-way valve means preventing the passage of air into said compressor through said outlet port.

27. The compressor device according to claim 22 and wherein said air inlet opening of said rotatable manifold assembly means is radially aligned with said air inlet port and axially spaced from said compressed air outlet port in said wall and said manifold assembly having a closed end wall adjacent said stationary partition wall.

28. The compressor device according to claim 22 and wherein said manifold assembly means is connected for rotational movement with said sun gear drive means.

29. The compressor device according to claim 24 and wherein said frame ring means are provided on opposed sides of said cylinders, said frame ring means being provided with bearing means for each of said simple eccentric cranks.

30. The compressor device according to claim 29 and wherein said sun gear drive means is generally coaxial with said manifold assembly means.

31. The compressor device according to claim 30 and wherein each said air outlet port is provided with one-way valve means preventing the passage of air into said compressor through said outlet port.

32. The compressor device according to claim 31 and wherein said air inlet opening of said rotatable manifold assembly means is radially aligned with said air inlet port and axially spaced from said compressed air outlet port in said wall and said manifold assembly having a closed end wall adjacent said stationary partition wall.

33. The compressor device according to claim 32 and wherein said manifold assembly means is connected for rotational movement with said sun gear means.

34. A positive displacement expander device, comprising:

(a) a stationary block means which includes a predetermined number of radially disposed equispaced cylinders and piston means therein such that a central manifold cavity is defined and wherein each cylinder has a wall separating it from said manifold cavity and wherein each said wall for each said cylinder is provided with a gas inlet port and a exhaust port which are generally axially spaced apart, (b) each said cylinder further including a separate simple eccentric crank mounted for rotatable movement radially outwardly of said wall such that a connecting rod interconnects the piston in said cylinder with said eccentric crank to cause driving rotation of said crank, (c) said expander component also including separate pinion gear means connected to each eccentric crank and a sun gear to which each of said pinion gears is operably connected, said sun gear also having power take-off drive means connected thereto, (d) rotatable generally cylindrical manifold assembly means located in said block and including a gas inlet compartment for receiving gases from said combustor and a gas outlet compartment axially separated from said gas inlet compartment by a partition wall, said manifold also having a gas inlet opening for coacting with said gas inlet port and a gas outlet opening for coacting with said gas outlet port whereby gas admitted to said cylinders through said gas inlet opening and said gas inlet port causes outward driving power movement of said pistons and whereby exhaust gases are exited through said gas outlet opening and said gas outlet port to said gas outlet compartment, and (e) said piston each being designed so as to include a first piston section to which each said eccentric crank is connected and free floating second section comprising the head portion of said pistons such that said second section is unconnected to and is able to freely disengage said first section upon the occurrence of a predetermined pressure with the cylinder.

35. The positive displacement expander device according to claim 34 and wherein said second piston section is formed to include a skirt portion depending from the head portion thereof.

36. The positive displacement expander device according to claim 35 and wherein said skirt portion further includes piston seal ring means which engage the cylinder wall.

37. The positive displacement expander device according to claim 36 and in which said manifold assembly means is connected for rotation with said sun gear.

38. The positive displacement expander device according to claim 36 and in which each said eccentric crank means for said expander component is provided with crank mounting shaft means rotatably received in bearing means and wherein said crank mounting shaft means are secured for positive rotation with pinion gear means operably connected to said sun gear.

39. The positive displacement expander device according to claim 36 and in which said manifold assembly means is connected for rotation with said sun gear.

40. The positive displacement expander device according to claim 36 and in which each said eccentric crank means for said expander component is provided with crank mounting shaft means rotatably received in bearing means and wherein said crank mounting shaft means are secured for positive rotation with pinion gear means operably connected to said sun gear.

* * * * *